US005498187A

United States Patent [19]

Eggleston et al.

[11] Patent Number: 5,498,187

[45] Date of Patent: Mar. 12, 1996

[54] METHOD OF MAKING AN IMPROVED TARGET/STEM ASSEMBLY - ROTOR BODY ASSEMBLY CONNECTION FOR X-RAY TUBES

[75] Inventors: Michael R. Eggleston, Scotia; Mark G. Benz, Burnt Hills; Melvin R. Jackson, Niskayuna; Robert J. Zabala, Schenectady, all of N.Y.

[73] Assignee: General Electric Company, Schenectady, N.Y.

[21] Appl. No.: 321,837

[22] Filed: Oct. 6, 1994

[51] Int. Cl.[6] ..... H01J 9/18

[52] U.S. Cl. ..... 445/28; 445/29; 378/144

[58] Field of Search ..... 445/28, 29; 378/125, 378/144

[56] References Cited

U.S. PATENT DOCUMENTS

| | | | |
|---|---|---|---|
| 4,367,556 | 1/1983 | Hubner et al. | 378/125 |
| 4,574,388 | 3/1986 | Port et al. | 378/125 |
| 4,670,895 | 6/1987 | Penato et al. | 378/125 |
| 4,736,400 | 4/1988 | Koller et al. | 378/125 |
| 4,995,065 | 2/1991 | Janouin et al. | 378/130 |

FOREIGN PATENT DOCUMENTS

| | | | |
|---|---|---|---|
| 2425082 | 11/1975 | Germany | 378/144 |
| 57-55041(A) | 4/1982 | Japan | 378/144 |
| 58-216349(A) | 12/1983 | Japan | 378/125 |
| 2-94236(A) | 4/1990 | Japan | 378/125 |

*Primary Examiner*—P. Austin Bradley
*Assistant Examiner*—Jeffrey T. Knapp
*Attorney, Agent, or Firm*—R. Thomas Payne; James Magee, Jr.

[57] ABSTRACT

A method of making a high performance x-ray system having a rotating anode includes making target/tubular stem assembly and then assembling it to a rotor body assembly. This particular method reduces tube failure due to anode assembly imbalance and provides an improved rotating x-ray tube anode assembly.

19 Claims, 12 Drawing Sheets

METHOD OF MAKING AN IMPROVED TARGET/STEM ASSEMBLY - ROTOR BODY ASSEMBLY CONNECTION FOR X-RAY TUBES

RELATED APPLICATIONS

This application is related to commonly assigned U.S. patent application Ser. No. 08/272,063 of Benz et al., filed Jul. 8, 1994, U.S. patent application Ser. No. 08/272,065 of Eggleston et al., filed Jul. 8, 1994, and U.S. patent application Ser. No. 08/272,064 of Eggleston et al., filed Jul. 8, 1994; and U.S. patent application Ser. No. 08/317,609 of Benz et al., U.S. patent application Ser. No. 08/321,024 of Benz et al., and U.S. patent application Ser. No. 08/321,022 of Benz et. al., filed currently herewith, the disclosure of each is hereby incorporated by reference.

BACKGROUND OF THE INVENTION

The present invention relates to methods for making equipment for diagnostic and therapeutic radiology and, more particularly, to methods for making high performance target/stem assemblies used in x-ray generating equipment, such as computerized axial tomography (C.A.T.) scanners. More particularly, the invention is directed to methods for making high performance rotating x-ray tube anode assemblies having a large bore, thin-walled tubular stem. Most particularly, it relates to methods for joining a target, such as, for example, a molybdenum-alloy disk, to a stem, such as, for example, a niobium-alloy tubular stem portion, wherein inserts, such as, for example, tantalum-alloy inserts, are used as the bonding material to form a target/stem assembly and then connecting the target/stem assembly to a rotor body assembly.

X-rays are produced when, in a vacuum, electrons are released, accelerated and then abruptly stopped. This takes place in the x-ray tube. To release electrons, the filament in the tube is heated to incandescence (white heat) by passing an electric current through it. The electrons are accelerated by a high voltage (ranging from about ten thousand to in excess of hundreds of thousands of volts) between the anode (positive) and the cathode (negative) and impinge on the target portion of the anode, whereby they are abruptly slowed down. The anode, usually referred to as the target, is often of the rotating disc type so that the electron beam is constantly striking a different point on the target perimeter. The x-ray tube itself is made of glass and contains a cathode plate, an anode assembly including a rotating disk target and a rotor that is part of a motor assembly that spins the target. A stator is provided outside the x-ray tube proximate to the rotor and overlapping therewith about two-thirds of the rotor length. The glass x-ray tube is enclosed in a protective casing having a window for the x-rays that are generated to escape the tube. The casing is filled with oil to absorb the heat produced by the x-rays. The casing in some x-ray tubes may include an expansion vessel, such as a bellows. High voltages for operating the tube are supplied by a transformer. The alternating current is rectified by means of rectifier tubes (or "valves") in some cases by means of barder-layered rectifiers.

For therapeutic purposes—e.g., the treatment of tumors, etc.—the x-rays employed are in some cases generated at much higher voltages (over 4,000,000 volts). Also, the rays emitted by radium and artificial radiotropics, as well as electrons, neutrons and other high speed particles (for instance produced by a betatron), are used in radio therapy.

In producing new and improved anode assemblies for rotary anode x-ray application, it is not only necessary for the improved target/stem connection to survive a more rigorous environment in the x-ray tube but it must also be able to survive more rigorous manufacturing processes such as the vacuum firing at temperatures up to about 1500 degree(s) C. This requires that the target/stem connection provide the following benefits:

1. The bonding temperature be low enough to not adversely affect the properties of the TZM alloy which can lose significant strength at about 2000 degree(s) C.
2. After bonding, have sufficient high temperature strength to support the bond through the additional manufacturing steps such as vacuum firing to about 1500 degree(s) C.
3. The bond should be strong and should not be degraded by thermal excursions during normal x-ray tube operation up to 1500 degree(s) C. for extended periods of time.

For a particular set of bonding metals, such as in diffusion bonding, to work under the above parameters, it must have certain inherent properties. The first would be that the metals do not have a eutectic or peritectic reaction with the TZM target layer. Ultimately, the bond metals used, such as in diffusion bonding, should form only a simple binary solid solution with the molybdenum in the TZM alloy.

A basic rule in bonding dissimilar materials is that for a bond to occur there must be some intermixing of the elements between the two materials. Also, for this bond to have significant strength, the gradation of intermixing should approximate that of a binary diffusion couple where the two materials diffuse together in equal portions.

Conventional target/stem connections, to the extent they may be viable in conventional x-ray imaging systems, face a much more severe test in connection with the use of graphite members in x-ray tubes used in medical computerized axial tomography (C.A.T.) scanners. For the formation of images, a medical C.A.T. scanner typically requires an x-ray beam of about 2 to 8 seconds duration. Such exposure times are much longer than the fractions-of-a-second exposure times typical for conventional x-ray imaging systems. As a result of these increased exposure times, a much larger amount of heat (generated as a by-product of the process of x-ray generation in the target region) must be stored and eventually dissipated by the rotating anode.

X-ray tube performance can be affected by the balance of the anode assembly (a combination of a target/stem assembly and a rotor body assembly) which includes the target, the stem and the rotor. Specifically, during x-ray tube manufacturing, it is important to be able to balance the anode assembly and have it stay balanced during completion of the manufacturing cycle and during operation of the x-ray tube. As the size of x-ray tube targets has increased to six and one half inch (6½") and beyond, it has proved difficult to maintain this balance and thus, reduced manufacturing yields and shortened x-ray tube operational lives have been experienced. Field evaluation of failed x-ray tubes has indicated that the imbalance of the anode assembly has often occurred in the region of the attachment of the target/stem or shaft assembly to the rotor body assembly.

Recently, the problem related to anode assembly failure due to imbalance reached a critical point. Due to the tremendous stresses undergone by the larger diameter x-ray tubes during continuous operation, the average tube life had been approximately 30,000 scan-seconds, utilizing the conventional threaded stem, Belleville washer mechanical connection.

Since approximately 20% of the failures were related to anode assembly imbalance, the need for new and improved methods of making an improved anode assembly having a new and improved, more durable target/stem assembly connection with the rotor body assembly that would eliminate the imbalance became apparent. The new and improved methods for making such a target/stem assembly desirably would provide sufficient anode assembly balance, when the target/stem assembly was connected to the rotor body assembly to form the anode assembly, during the operation life of the target/stem assembly-rotor body assembly connection while reducing significantly, if not entirely eliminating, tube failures due to anode assembly balance problems.

SUMMARY OF THE INVENTION

In carrying out the present invention in preferred forms thereof, we provide improved methods for making an x-ray anode assembly for use in x-ray tubes, such as those incorporated in diagnostic and therapeutic radiology machines, for example, computer tomography scanners. Illustrated embodiments of the resulting x-ray anode assembly made utilizing the inventions disclosed herein, are in the form of an x-ray system having an x-ray tube which includes the improved anode assembly.

In accordance with one aspect of the present invention there is provided a method for making an x-ray system having an x-ray tube having a metallic target and a large bore, thin-walled stem bonded together to form a target/stem assembly which, when connected to a rotor body assembly, results in a balanced rotating x-ray tube anode assembly.

Another aspect of the present invention includes a method for connecting a target/stem assembly to a rotor body assembly for use in a rotating x-ray tube, comprising the steps of: providing a target; providing a large bore, thin-walled tubular stem; providing a bottom plate; connecting the bottom plate to the tubular stem; connecting the tubular stem/bottom plate combination to the target; machining the bottom plate to obtain proper target/stem assembly balance and proper alignment between the bottom plate and the target/stem assembly; positioning the target/stem assembly proximate a rotor body assembly; and the rotor body assembly; and connecting the target/stem assembly to the rotor body assembly to form an anode assembly.

The preferred target/tubular stem assembly, as utilized in the methods of the present invention includes a thin walled, large-bore stem. The advantages of thin-walled, large-bore stem include:

1) The strength and stiffness of the stem in bending and torsion are significantly improved over a small-diameter stem. 2) The tensile properties of the large-bore stem are nearly the same as a small-diameter stem. 3) The same thermal resistance offered by the small-diameter stem can be obtained by controlling the wall thickness of the large-bore stem.

Calculations have indicated that the thinness of the wall is limited by: 1. Buckling behavior under torsion and other loadings. 2. Strength/stiffness of the shaft in tension. 3. Ability to obtain and work with a thin-walled shaft.

Accordingly, an object of the present invention is to provide a method for making an x-ray system including an improved x-ray tube having increased scan life.

A further object of the present invention is to provide a method for making an x-ray tube having an improved anode assembly which maintains proper balance during the life of the x-ray tube in an x-ray system.

A still further object of the present invention is to provide a method for making a target/stem assembly—rotor body assembly connection that will prevent x-ray tube failure due to anode assembly imbalance for at least 40,000 scan-seconds.

Another object of the present invention is to provide a method for making a target/stem assembly—rotor body assembly connection that results in improved manufacturing yields.

Other objects and advantages of the invention will be apparent from the following description, the accompanying drawings and the appended claims.

DESCRIPTION OF EMBODIMENTS MADE IN ACCORDANCE WITH THE PREFERRED METHODS

Figure 1A:
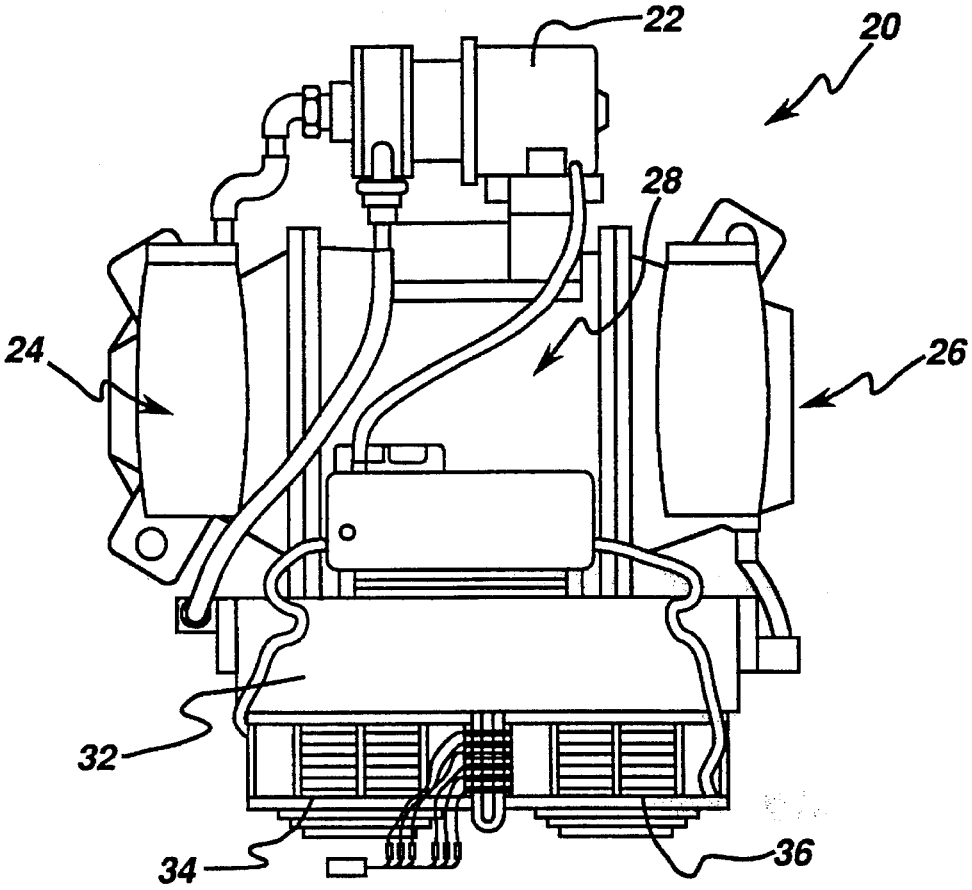
fig. 1a PRIOR ART
FIG. 1*a* is a plan view of a representative x-ray system.
Figure 1B:
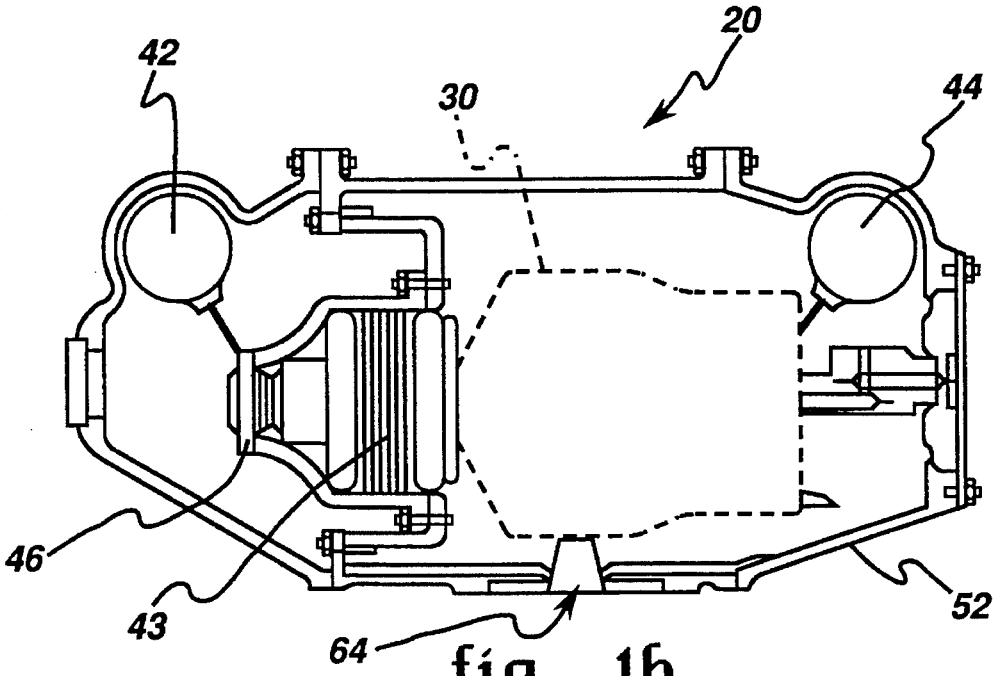
fig. 1b PRIOR ART
FIG. 1*b* is a sectional view with parts removed of the x-ray system of FIG. 1*a;*
Figure 2:
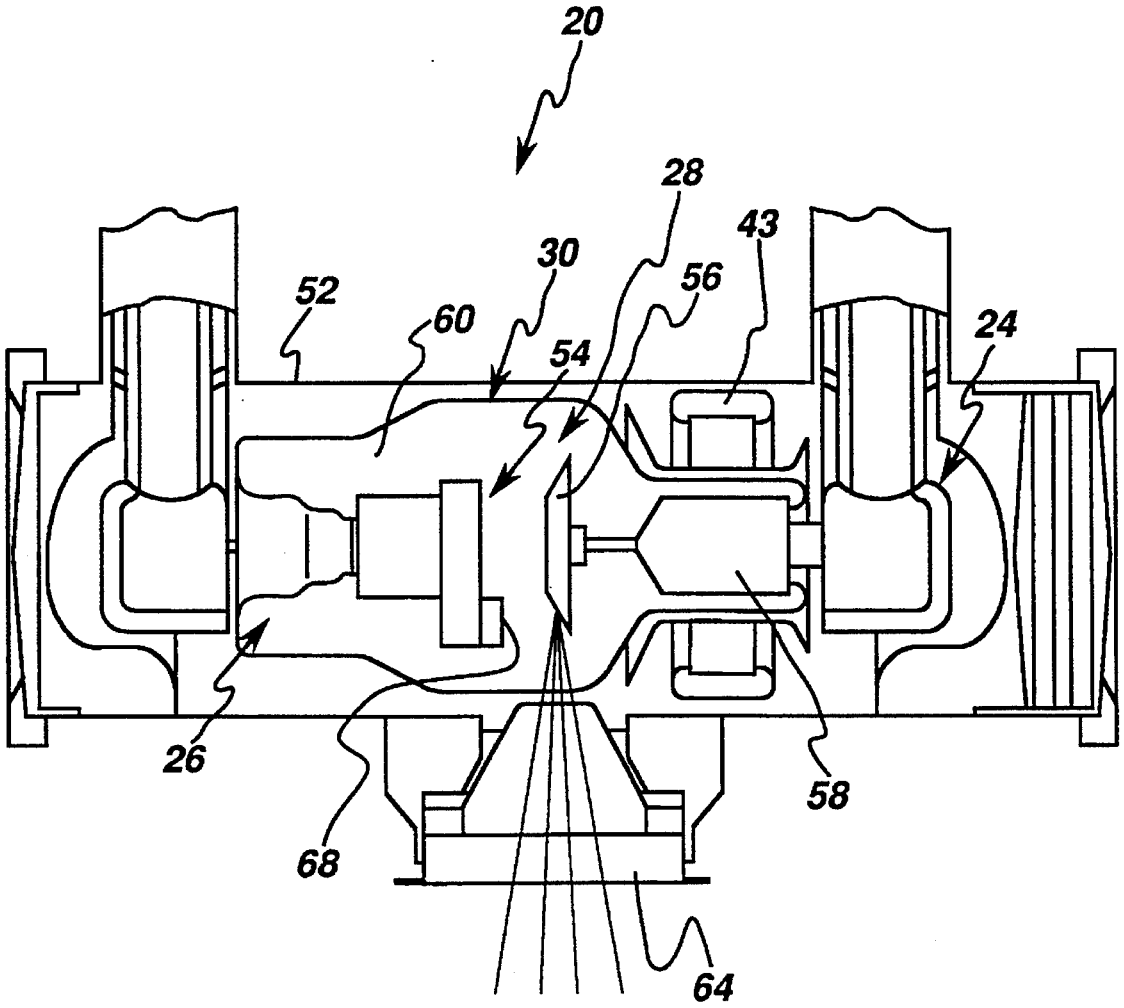
fig. 2 PRIOR ART
FIG. 2 is a schematic representation of another representative x-ray system having an x-ray tube positioned therein.

A representative x-ray system in which an x-ray tube made, in accordance with the methods of the present invention, is illustrated as generally designated by the numeral 20 in FIGS. 1*a*, 1*b* and 2. As can be seen, the system 20 comprises an oil pump 22, an anode end 24, a cathode end 26, a center section 28 positioned between the anode end and the cathode end, which contains the x-ray tube 30. A radiator 32 for cooling the oil is positioned to one side of the center section and may have fans 34 and 36 operatively connected to the radiator 32 for providing cooling air flow over the radiator as the hot oil circulates therethrough. The oil pump 22 is provided for circulating the hot oil through the system 20 and through the radiator 32, etc. As shown in FIG. 1*b*, electrical connections are provided in the anode receptacle 42 and the cathode receptacle 44.

As shown in FIG. 2, the x-ray system 20 comprises a casing 52, preferably made of aluminum and lined with lead, a cathode plate 54, a rotating target 56 and a rotor 58 enclosed in a glass envelope 60. A stator 43 is positioned outside the glass envelope 60 inside the lead lined casing 52 relative to the rotor 58. The casing 52 is filled with oil for cooling and high voltage insulation purposes as was explained above. A window 64 for emitting x-rays is operatively formed in the casing 52 and relative to the target 56 for allowing generated x-rays to exit the x-ray system 20.

Figure 3:
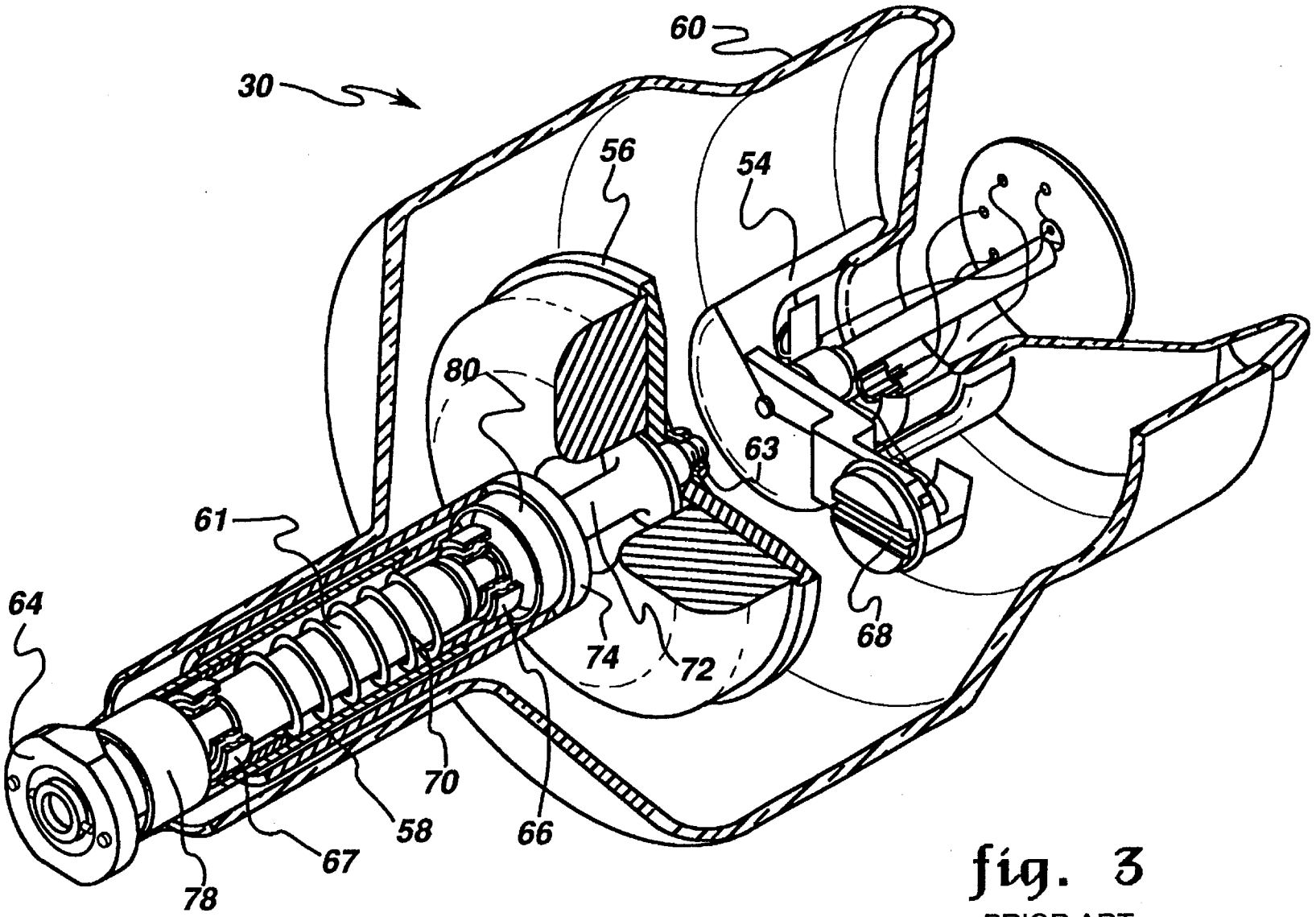
fig. 3 PRIOR ART
FIG. 3 is a partial perspective view of a representative x-ray tube with parts removed, parts in section, and parts broken away.

Referring to FIG. 3, there is shown the cathode 54 positioned inside the glass envelope 60. As is well known, inside the glass envelope there is a vacuum of about $10^{-5}$ to about $10^{-9}$ torr. The electricity generates x-rays that are aimed from the cathode filament 68 to the top of the target 56. The target is conventionally connected to a rotating shaft 61 at one end by a Belleville nut 63 and by another nut at the other end 64. A front bearing 66 and a rear bearing 67 are operatively positioned on the shaft 61 and are held in position in a conventional manner. The bearings 66 and 67 are usually lubricated and are susceptible to failure at high operating temperatures.

A preload spring 70 is positioned about the shaft 61 between the bearings 66, 67 for maintaining load on the bearings during expansion and contraction of the anode assembly. A rotor stern/stud 72 is utilized to space the end of the rotor most proximate the target 56 from the rotor hub 74. The bearings, both front 66 and rear 67, are held in place by bearing retainers 78 and 80. The rotor body assembly also includes a stem ring and a stem, all of which help to provide for the rotation of the rotor 58 with the target 56.

The temperature in the area of the filament 68 can get as high as about 2500° C. Other temperatures include about 1100° C. near the center of the rotating target 56, which rotates at about 10,000 rpm. Temperatures of the focal spot on the target 56 can approximate 3200° C. and temperatures on the outside edge of the rotating target 56 approach about 1300° C. The temperature in the area of the rotor hub 74 approaches 700° C. and of the front bearing approaches 450° C. maximum. Obviously, as one moves from the target 56 to the rotor 58 and stator 43, the temperature appears to decrease.

During operation of some x-ray systems having larger diameter targets, severe protocol users have maximized usage of the system by making as many scans at high peak power in as short a time as possible. One of the problems with utilizing any x-ray system in this continuous type of operation is the amount of heat that is generated, which may in fact destroy the bearings 66, 67, especially the front beading 66.

If the x-ray tube target 56 and rotor 58 were allowed to continue to rotate at 10,000 rpm between scans, the bearings would wear out prematurely and cause the tube to fail. Thus, if it appears that there would to be more than 60 seconds between scans, the x-ray system operating control system software is programmed to brake the rotor by rapidly slowing it completely down to zero (0) rpm. However, when ready to initiate a scan, the control system software is programmed to return the target and the rotor to 10,000 rpm as quickly as possible. These rapid accelerations and brakes are utilized because, among other reasons, there are a number of resonant frequencies that must be avoided during the acceleration from zero (0) to 10,000 rpm and the brake from 10,000 rpm to zero (0) rpm. In order to pass through these resonant frequencies both immediately before a scan or a series of scans and after a scan or series of scans as fast as possible, the x-ray system applies maximum power to bring the target, or anode assembly, to 10,000 rpm or down to zero (0) rpm in the least amount of time possible.

It should be noted that the x-ray tube target and rotor can be accelerated to 10,000 rpm from a dead stop in about 12 to about 15 seconds and slowed down at about the same rate. Vibration from the resonant frequencies is a problem, if the tube is allowed to spin to a stop without braking.

It has been found that during these rapid accelerations to 10,000 rpm and the immediate braking from 10,000 rpm to zero, stresses, mechanical as well as thermal, impact on the rotor 58 and especially on the target/stem-rotor body assembly connection. These stresses may contribute to anode assembly imbalance which is believed to be the leading cause of recent x-ray tube failures. It has been determined that these imbalance problems are most likely caused by changes that occur in the area of the target 72/stem assembly—rotor 58 body assembly connection.

Figure 4:
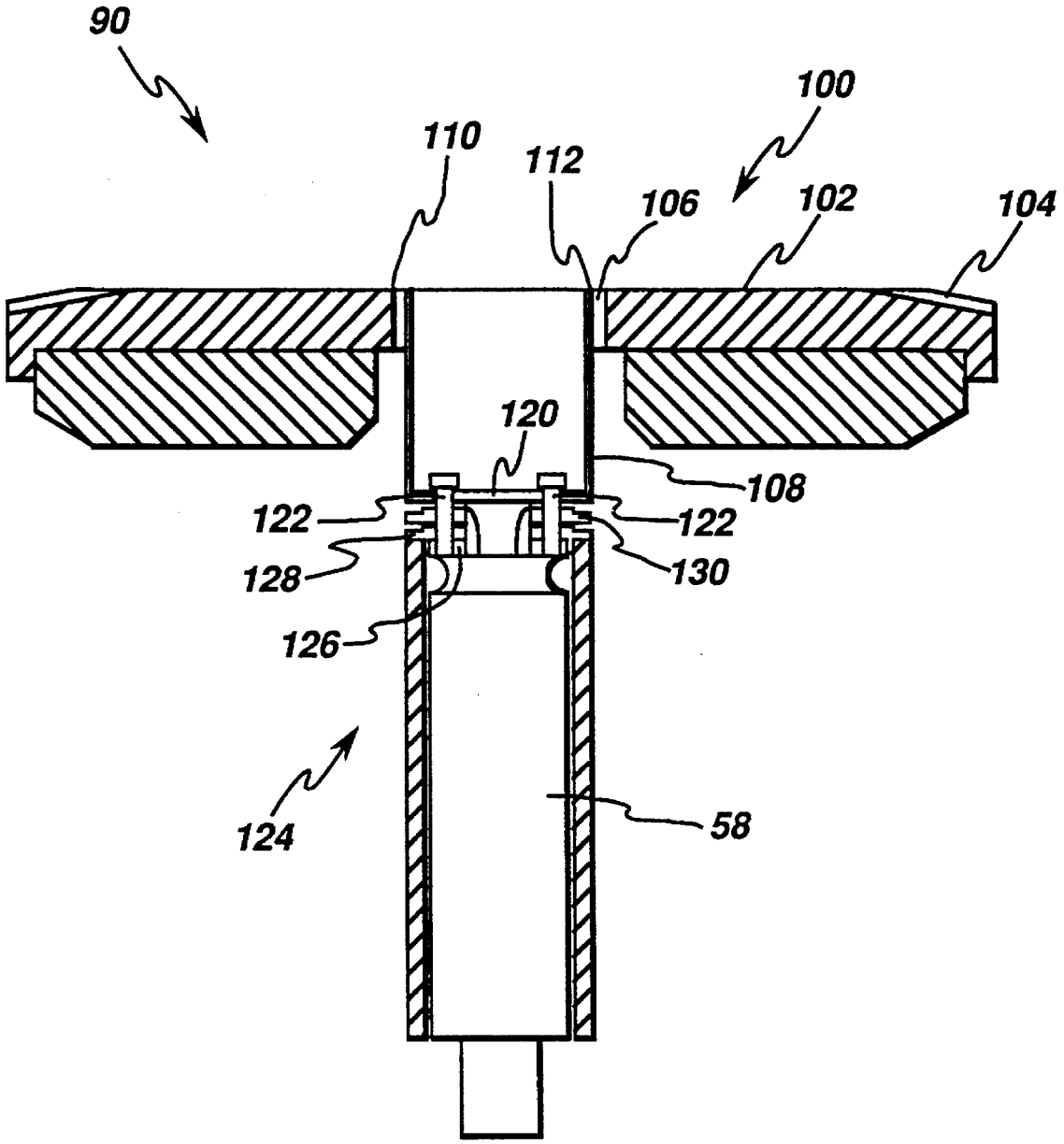
FIG. 4 is a sectional view of one embodiment of an x-ray tube target/stem-rotor body assembly connection resulting from the methods of the present invention.

Referring now to FIG. 4, therein is shown a representative anode assembly made in accordance with the method(s) of the present invention, generally designated by the reference numeral 90. The anode assembly 90 includes a target/stem assembly 100 and a rotor body assembly 124.

The target/stem assembly 100 comprises the target 102, preferably made of molybdenum alloy TZM, and, a focal track 104, operatively connected to the target by conventional metallurgical means, for reflecting the x-rays generated by the cathode 68 through the window 64 (as shown in FIG. 2). An insert 106 for diffusion bonding to a tubular stem 108, preferably one having a large bore and a thin-wall, is preferably co-processed with the target 102 during the manufacture thereof. The target 102 is preferably a powder-metallurgy-alloy preferably compatible with all processes used for target manufacture including: powder making, die pressing, sintering, forging, annealing, and coating or brazing to a graphite back (not shown). The insert 106 alloy should also be able to maintain a small grain size, high strength and good ductility during the combination of process steps utilized during the manufacture of the target which includes the insert 106 being operatively connected to the internal portion of the target 102 along seam 110. One such insert material is tantalum. The material for the insert 106 could also be selected from a group of Tantalum alloys comprising: Ta-10W (Ta,10W); T-111 (Ta,8W,2Hf); T-222 (Ta,9.6W,2.4Hf,0.01 C); ASTAR-811C (Ta,8W,1Re,1Hf, 0.025C); GE-473 (Ta,7W,3Re); Ta-2.5W (Ta, 2.5W); and Ta 130 (Ta with 50–200 ppm Y) or other metals which meet the above criteria and which can maintain the bond between the tubular stem and the target for at least about 40,000 scan seconds.

The tubular, preferably having a large bore and a thin-wall, stem 108 is preferably made of Nb and more preferably from an Nb-based alloy chosen from the group comprising: CB-752 (Nb,10W,2.5Zr); C129Y (Nb,10W,10Hf,0.1Y); FS-85 (Nb,28Ta,11W,0.8Zr); C103 (Nb,10,Hf,1Ti,0.7Zr), of which C103 is most preferred, or other metals which can maintain the bond between the tubular stem and the target for at least about 40,000 scan seconds when used as described above. The tubular stem end 112 which would make contact with the insert 106 is slightly tapered as is the insert 106. This tapering is to facilitate press fitting the tubular stem 108 into the insert 106 so that sufficient pressure between the two for diffusion bonding is provided. This pressure is preferably provided by a light press-fit of the tubular stem into the insert. The bonding between the tubular stem and the target via the insert is preferably accomplished by vacuum annealing for a sufficient time (about 3 hours) at a sufficient temperature (preferably higher than 1150° C.) and at a sufficient contact pressure (preferably greater than 10,000 psi) to effectuate diffusion bonding.

One advantage of the materials for both the tubular stem 108 and the insert 106, as mentioned above, is that the coefficient of thermal expansion of the tubular stem material is greater than the coefficient of thermal expansion of the insert material which is in turn greater than the coefficient of thermal expansion of the target material.

In order to achieve effective bonding, such as diffusion bonding, between all three components, intimate contact between adjacent components at the temperature for bonding, preferably diffusion bonding, is required. The difference of the coefficient of thermal expansion stated above at bonding, preferably diffusion bonding, temperatures results in a compressive pressure between the components (tubular stem 108, insert 106 and target 102) thereby ensuring the necessary intimate contact.

Figure 5A:
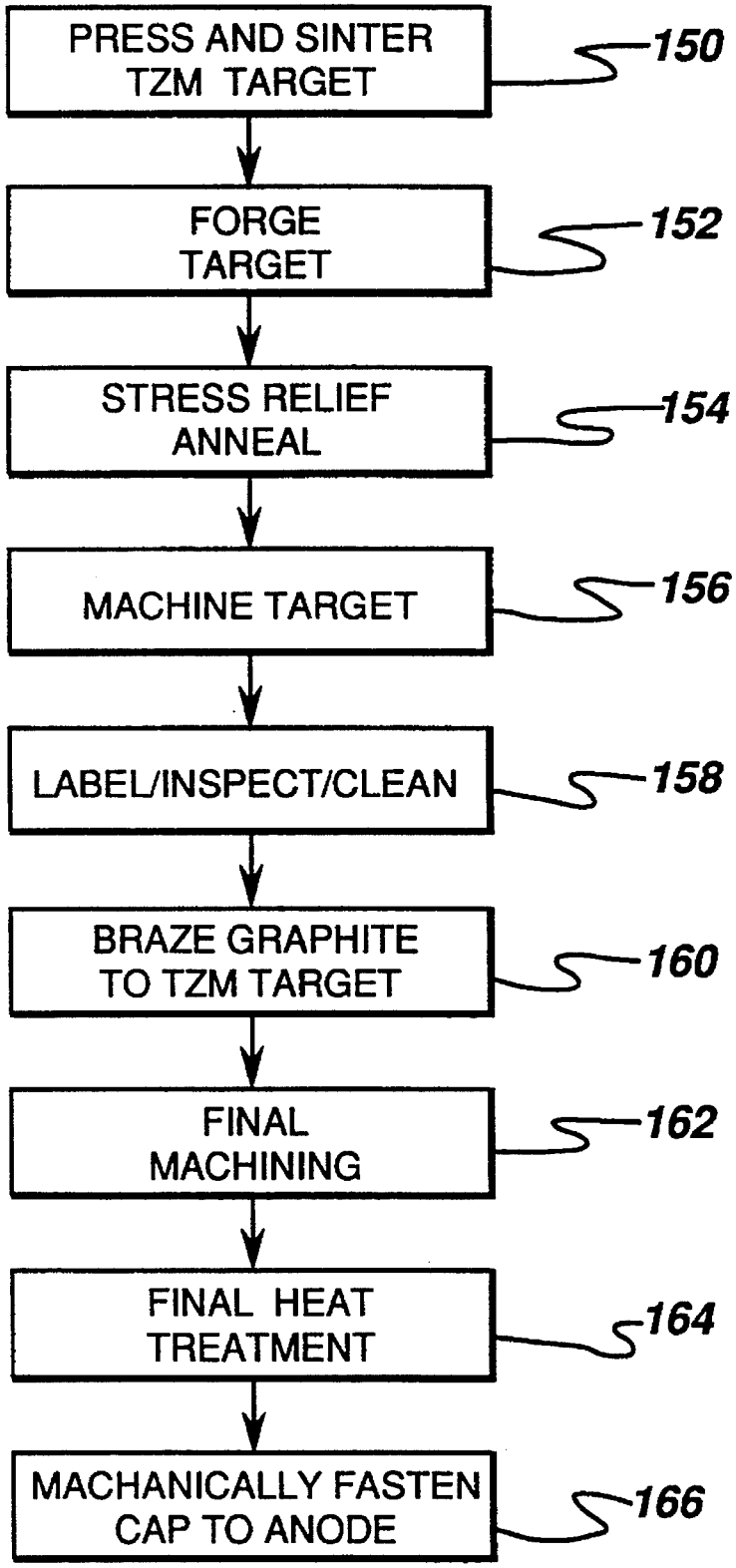
fig. 5a (PRIOR ART)
FIG. 5*a* is a process diagram illustrating one prior art method for connecting a target to a stem to form an anode assembly.

During the manufacture of a prior art target 56/stem 72 combination (see FIG. 3), as illustrated in FIG. 5*a*, the first step 150 was to press and sinter the TZM target at about 2200° C. in vacuum or at a conventional temperature. Next, the target was forged 152 at about 1400° C. to about 1600° C. After forging, a stress relief anneal 154 was performed at a temperature of about 1500° C. to about 1900° C. in a vacuum. After the stress relief anneal, the target was machined 156. Thereafter, as optional steps, the target was first labeled/inspected/cleaned 158 and then graphite was brazed 160 (at a temperature of about 1700° C. to about 1800° C.) to the TZM target. Then the target or the optional target/graphite combination was final machined 162 prior to final heat treatment 164 after which point the stem 72 was attached 166 to the target 56 by washer 63, as shown in FIG. 3.

Figure 5B:
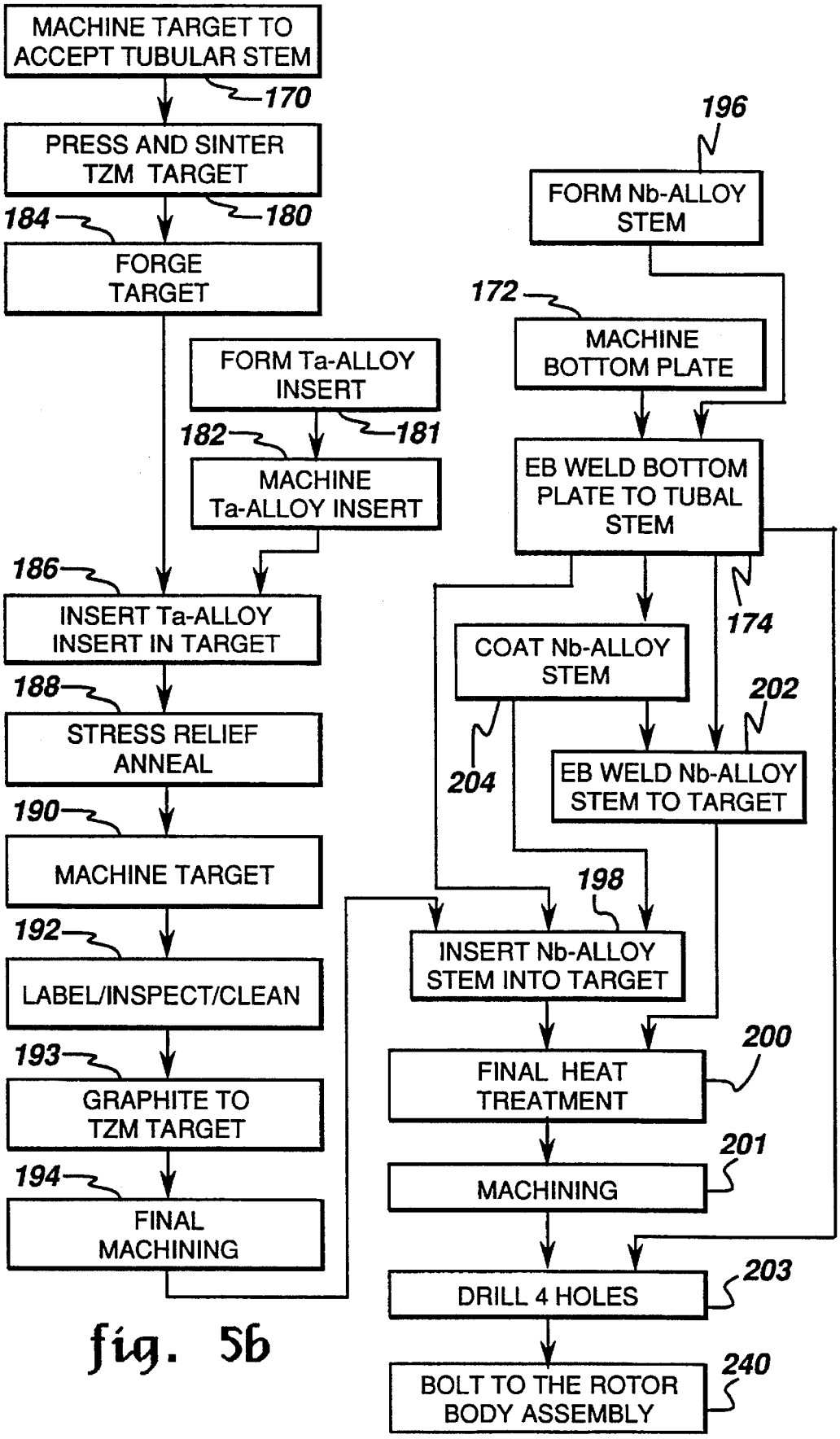
FIGS. 5*b–e* are process diagrams illustrating possible methods of the present invention utilized to connect the target to a large bore, thin-walled stem to form an improved target/stem assembly.

Utilizing the insert 106 and tubular stem 108, in one manufacturing method of the present invention, as illustrated in FIG. 5*b*, to form an improved target/stem assembly 100, the target is machined to accept a tubular stem with a light press-fit 170; the bottom plate 120 is machined 172 separately; the bottom plate is connected, preferably by EB (electron beam) welded 174, to the tubular stem and then the, preferably TZM, target 102 is pressed and sintered 180. Also separately, the insert 106 is first formed 181 and then machined 182.

Returning to the target, the target is forged 184 and the insert 106 is inserted 186 into the target 102 followed by the stress relief anneal step 188 at about 1500° C. to about 1900° C. for diffusion bonding of the insert to the target. Next, the target/insert combination is machined 190. Optionally, the target/insert combination can be labeled/inspected/cleaned 192 and graphite 107 can be brazed 193 to the target prior to the final combination being machined 194.

Separately, the large bore, thin-walled tubular stem 108 is formed 196 of, preferably, an Nb-alloy, and is inserted 198 into the target/insert combination where it undergoes final heat treat 200 at about 1200°–1600° C. to form the target/stem assembly 100.

Alternatively, the Nb-alloy tubular stem, after insertion 198 into the target/insert combination, is EB welded 202 to the insert to the form the target/stem combination 100, prior to final heat treat 200.

Figure 5C:
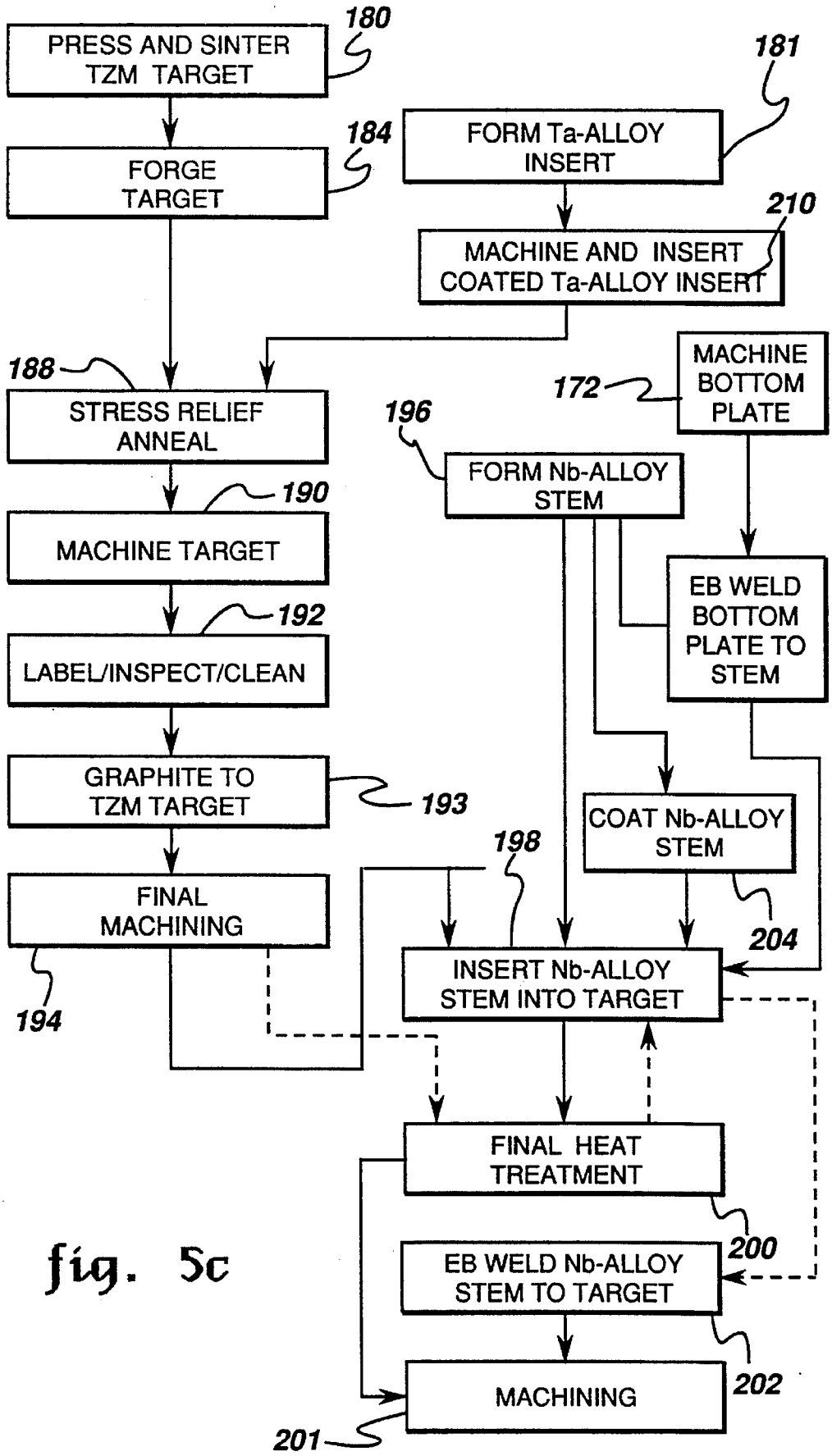

In another alternative method, as shown in FIG. 5*c*, the Nb-alloy tubular stem is coated 204 and then inserted 198 into the target/insert combination and then undergoes final heat treatment 200.

In yet another possible method, as also shown in FIG. 5*c*, the machined 194 target/insert combination undergoes final heat treat 200 at 1200°– 1600° C. and is then EB (electron beam) welded 202 to the tubular stem 108.

In another alternate method as also shown in FIG. 5*c*, the first steps are the same as the previous methods including the forging 184 of the target. A coated Ta-alloy insert is machined and inserted 210 into the target followed by the stress relief anneal 188 to diffusion bond the Ta-alloy insert to the TZM target, as explained above.

Figure 5D:
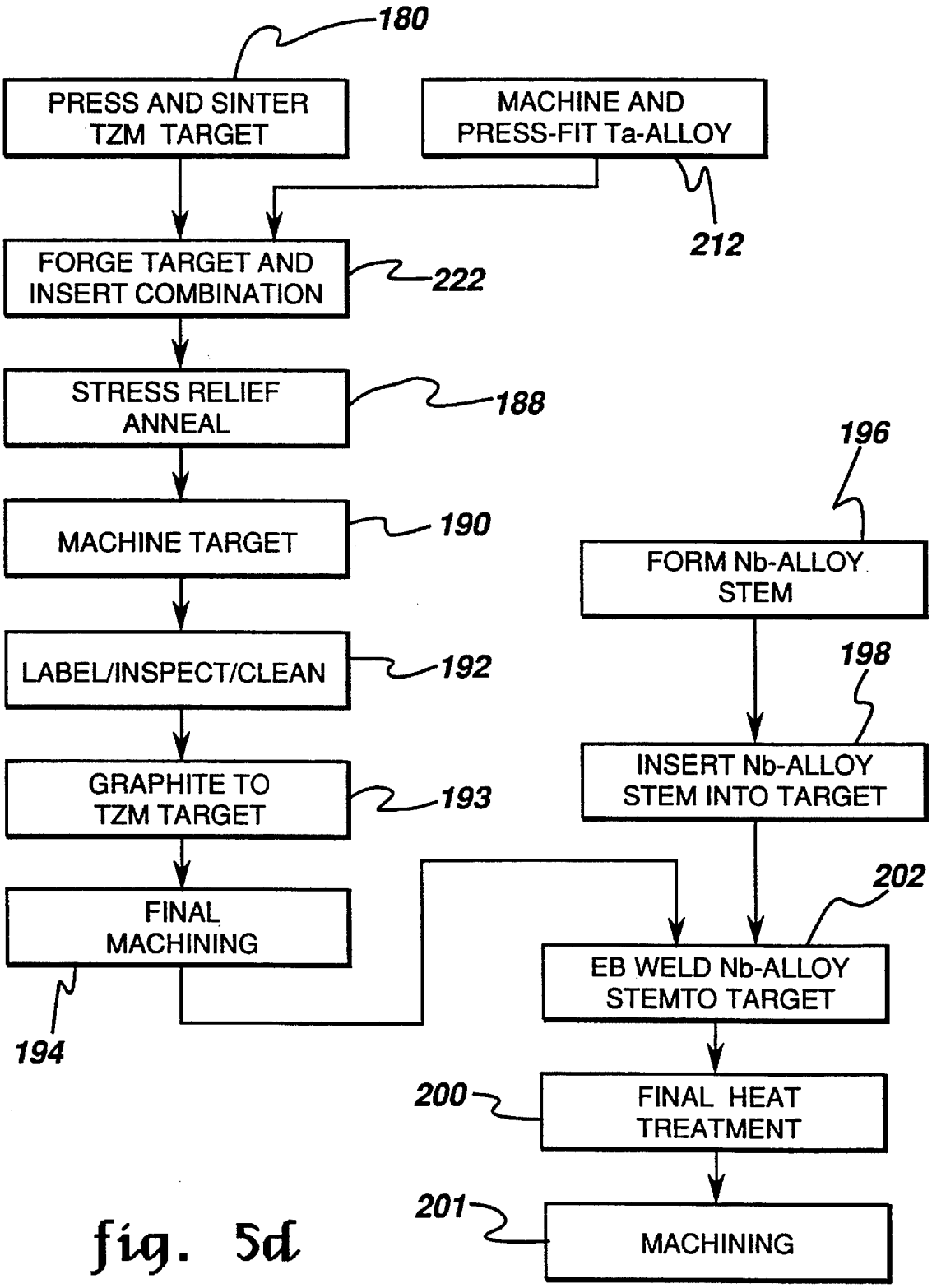

In still another alternative method, as illustrated in FIG. 5*d*, the target is pressed and sintered 180 and the insert is separately machined and press fitted 212 into the target. The combination is then forged 222 at 1400°– 1700° C. followed by stress relief anneal 188 at 1500° C. to approximately 1900° C., machined 194, and then a tubular stem 108 is inserted according to one of the four situations described below.

Figure 5E:
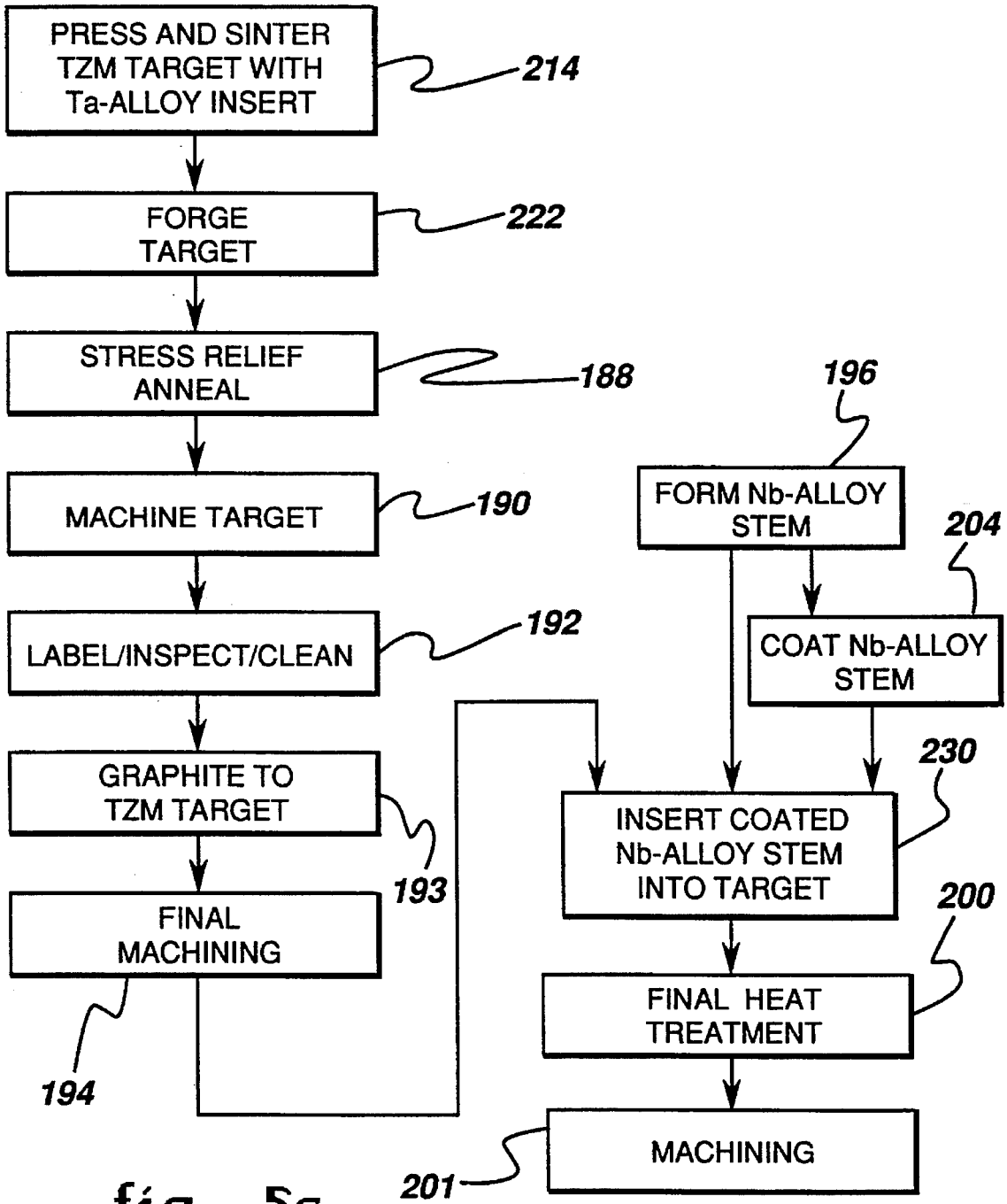

In yet another alternative method, as illustrated in FIG. 5*e*, the target, in powder form, is pressed and sintered with the insert, in powder form, 214 in a single step. The combination is then forged 222 at 1400°–1700° C. followed by stress relief anneal 188 at 1500° C. to approximately 1900° C., machined 194, and then an Nb-alloy tubular stem 108 is inserted according to one of the four situations described below.

As shown in FIGS. 5*b–e*, after the target/insert combination has been final machined 194, one of the following four processes is performed thereon. After the formation 196 of the preferably, Nb-alloy tubular stem (FIG. 5*c*), the stem is inserted 198 into the target/insert combination and then undergoes final heat treat 200 at 1200° C.–1600° C. in order to diffusion bond the Ta-target insert to the stem.

An alternative method of attaching the tubular stem to the target insert combination is to EB weld 202 the Nb-alloy tubular stem to the target/insert combination (FIG. 5*d*) and thereafter heat treat 200 the new combination at the temperature range mentioned above to complete the diffusion bonding between the Ta insert and the Nb stem.

A third method is, as shown in FIG. 5*c*, after the Nb-alloy tubular stem is formed 196, and the target/stem combination undergoes final heat treat 200, at the temperature ranges mentioned above, the Nb-alloy tubular stem is EB welded 202 to the target/insert combination followed by a machining step 201.

As also illustrated in FIG. 5*e*, an additional alternative method is, after the forming of the Nb-alloy tubular stem 196, the tubular stem is coated 204 and thereafter the stem 108 is inserted 230 into the target/insert combination followed by final heat treat 200 at the temperature ranges mentioned above for the diffusion bonding of the Ta to the Nb via the coating.

In all of the above possible methods of bonding the target to the tubular stem, the final step is machining 201, if necessary.

After each of the alternate methods described above has been completed and it has been determined that a centering plug is concentric with the axis of rotation and that a tight fit exists in the hole in the top flange of the rotor body, a plurality, preferably four bolt holes are drilled 203 in the bottom plate 120. Finally, the target/tubular stem assembly 100 is bolted 240 to the rotor body assembly 124.

Of the process mentioned above, there are certain advantages to processing the materials in specific orders. For example, an advantage of co-sintering the target and the insert is that the powders of the two alloys will intermix near the interface. This will provide a larger surface area for interdiffusion between the alloys. Sintering, which is performed at 2200° C., provides additional interdiffusion because of the higher temperature.

An advantage of inserting the insert into the target before forging is that the mechanical work resulting from the forging increases the surface area between the two parts. This particular process will also break up the contacting surfaces and create new interface surfaces which should enhance interdiffusion. An advantage of inserting the insert into the target after forging is that heating of the forge, which is required for the forging operation, might be easier if the insert is not forged with the target. An advantage of inserting the stem into the target/insert combination prior to heat treatment is that the diffusion bonding, upon exiting heat treatment, creates the final bond. Thus, no additional steps or processes are required to ensure the fastening of the stem to the target/insert combination. An advantage of electron beam welding the stem into the insert before heat treatment is that the materials used provide for a strong weld, which will assist in overcoming any weaknesses in the diffusion bond. Also, electron beam welding before heat treatment is believed to assist in the correct location of the stem in the target/insert combination. An advantage of electron beam welding the stem into the insert after heat treatment is that the relative position of the stem and the insert will not be altered by the high temperature exposure. Additionally, the stem material would not be weakened by the high temperature exposure.

As mentioned above, at least one of the possible processes requires that a Ta-alloy insert be coated. The term "coating" in this case is used to refer to a "consumable braze" or a "diffusion enhancer."

In one particular method, a thin layer of metal between the two contacting surfaces (e.g., a stem of, for example, C103, and an insert of, for example, (Ta-10W), can enhance the interdiffusion between the two metals. If the Nb and Ta-alloy surfaces are placed in contact at elevated temperatures, interdiffusion occurs. Nb atoms diffuse into the Ta-alloy and Ta atoms diffuse into the Nb-alloy. However, both Ta and Nb alloys will diffuse faster in Ti (as an example) than Ta or Nb. If a thin layer of Ti is placed between the contacting surfaces, both Ta and Nb atoms will rapidly diffuse into the Ti coating and intermingle. The Ti atoms will concurrently diffuse into the Ta-alloy and Nb-alloy metals. As the Ti diffuses away, it leaves a region of mixed Ta and Nb-alloys, thereby enhancing the diffusion bond that could be accomplished with the two alloys alone. The key to the use of the coating is that it must be thin enough so that after a reasonable amount of time most of the coating will have diffused into the two base metals (e.g. Nb and Ta-alloy). Also, the rate of diffusion of the Ta and Nb in the coating layer, for example Ti, must be higher than in Nb and Ta, respectively.

In one specific experiment of the above coating on a diffusion couple, after approximately 3 hours at about 1400° C. with a 1 mm Ti coating thickness, no Ti-rich regions existed. Where the Ti coating was placed, a region of Ta, Nb and Ti now exists e.g. while coating may have been 1 mm in thickness, after diffusion bonding, no Ti-rich ( i.e. percent Ti>50%) region exists, but Ti is present at some level more than 10 mm from the original interface.

Specifically, when bonding C103 to Ta10W with no coating at 1300° C. for about three hours, it was found that there was less than 4 microns of interdiffusion. However, when bonding C103 to Ta-10W with a 1 micron Ti coating at 1300° C. for about three hours, it was found that there was about 10 microns of interdiffusion.

Examples of potential coating materials includes: titanium; niobium-titanium alloys; aluminum; and titanium-vanadium-zirconium alloys (zirconium at less than 30 atom percent).

While the above list of potential coatings should appear adequate, any coating material should provide for the enhanced diffusion of Nb, Ta and Mo into the coating material. Any coating material when combined with Nb, Ta and Mo should remain solid at heat treatment conditions. Any elements in the coating should have at least some level of solubility in Nb, Ta and Mo alloys or other materials chosen for the stem, the insert and the target, respectively.

Figure 7:
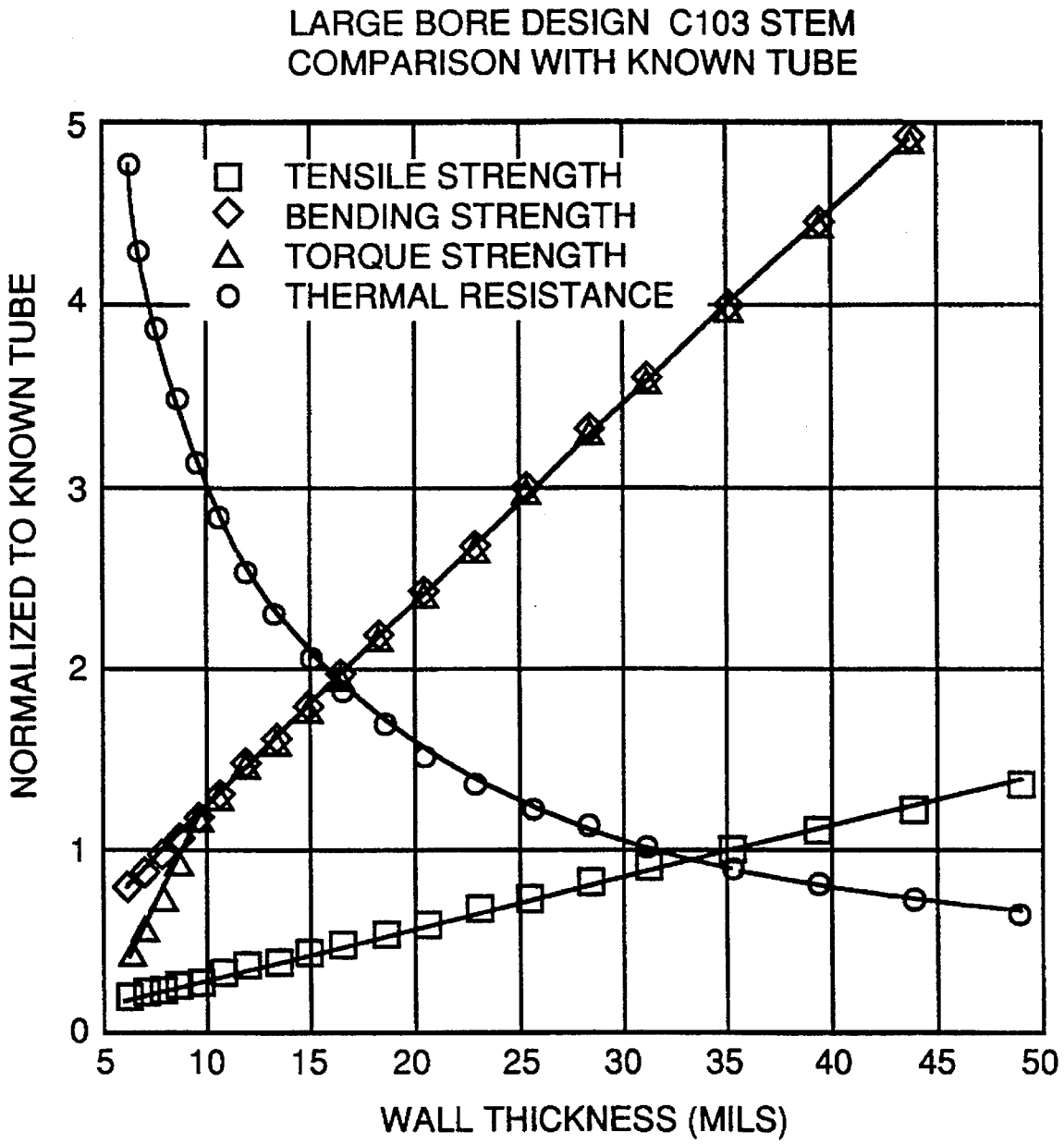
FIG. 7 is a graph illustrating calculations for a stem for a large bore tubular stem anode of C103 with various wall thicknesses.

During the described process, when choosing material to fabricate the tubular stem 108, calculations were prepared for both TZM and C103 in order to estimate the required stem wall thickness. The properties used for TZM at 1100° C. were approximated from reference data. The outer diameter of the stem was assumed to be 1.5 inches. FIG. 7 plots these calculations for various wall thicknesses. All of the calculations were normalized against similar calculations for a known tube stem geometry. A strength number under 1.0 does not necessary represent a design concern; more information must be known about the loadings that the anode is subjected to.

Once the bimetal target is made, the large bore, thin-walled stem needs to be attached. In one method, the stem is welded to the insert after the graphite braze cycle. The use of these ductile alloys avoids the possibility of manufacturing cracks which could grow during service and affect the life of the x-ray tube being created during the welding processes. Tests have also shown that diffusion bonding between the stem and insert can create a solid bond which is as strong as the base metals.

Figure 6:
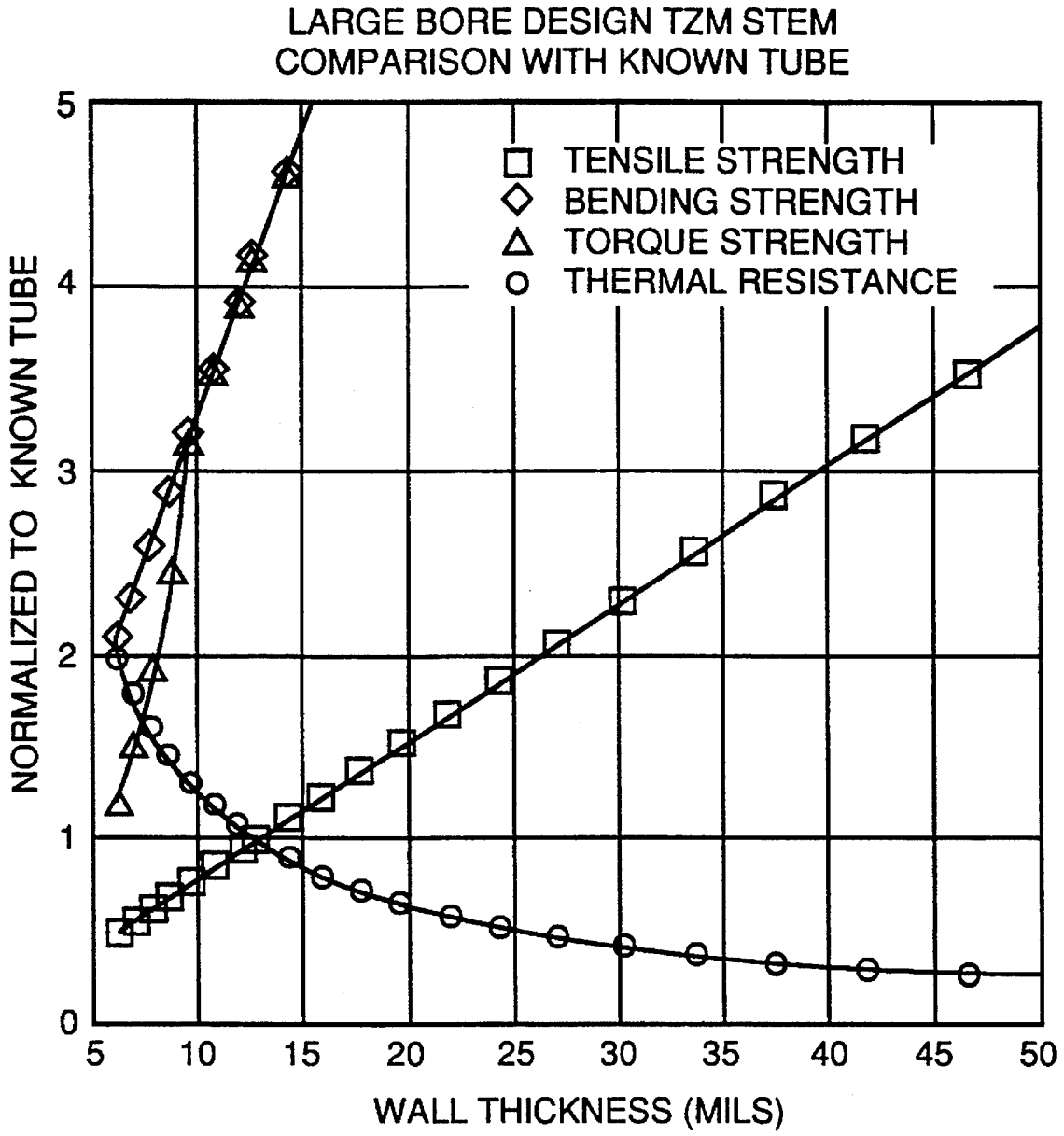
FIG. 6 is a graph illustrating the requirements for stem wall thickness for a large bore tubular stem made of TZM.

Calculations to estimate the requirements for stem wall thickness of a large bore, thin-walled tubular stem have been performed. In the calculations, the properties used for TZM at 1100° C. were approximated from reference data. The outer diameter of the tubular stem was assumed to be 1.5 inches. FIG. 6 plots these calculations for various wall thicknesses for TZM tubular stem material. All of the calculations were normalized against similar calculations for a known x-ray tube stem (OD=0.438"; wall thickness= 0.050").

The large bore, thin-walled stem 108 appears to provide much more strength/stiffness in bending and torsion than the known tube geometry. For small wall thicknesses, buckling is sometimes predicted (e.g., for torsion below 10 mils). The thermal resistance of the large bore, thin-walled stem decreases with increasing wall thickness. At about 13 mils, the large bore, thin wall TZM stem offers the same thermal resistance as the known tube stud. For wall thicknesses greater than 13 mils, the tensile strength of the TZM stem increases, but the thermal resistance of the stem decreases.

Discussions with TZM tube vendors have indicated that the minimum possible wall thickness is 25 to 30 mils because tube cracking or warpage would most likely result during the manufacture of a tube having a wall thinner than 25 mils.

In summary, the calculations have shown that for a large bore, TZM thin-walled stem: 1) A shaft tensile strength equivalent to the known tube stem is obtained with a 13 mil wall. 2) The bending/torsional strength and stiffness of the TZM stem are more than four times that of the known tube stem for a wall thickness greater than 13 mils. 3) Buckling of the shaft in torsion could be a concern for TZM stem walls less than 13 mils thick. 4) For the stem to provide the same thermal resistance as the known tube stem, a 13 mil wall is required while a 25 mil wall provides only half the thermal resistance of the known tube stem.

Calculations for a large bore, thin-walled stem made of niobium-alloy C103 have also been performed. As is known, C103 offers less strength and less stiffness than TZM. However, the increased thermal resistance that C103 offers appears to make its use appealing as an x-ray tube large bore, thin-walled tubular stem. In addition, the ductile nature of C103 allows it to be formed very easily, and allows for a variety of welding and other joining techniques.

FIG. 7 illustrates calculations for a C103 large bore, thin-walled stem having various wall thicknesses. All results were normalized against similar calculations for the known tube stem made with TZM. As can be seen, the large-bore stem provides much more strength/stiffness in bending and torsion than the known tube stem. Although the bending and torsional strength of the C103 large bore, thin-walled stem is not as large as the TZM large bore, thin-walled stem, the geometric advantage of the large bore, thin-walled stem design provides much more strength than the known tube stem. At about 33 mils, the large bore, thin-walled stem is expected to offer the same thermal resistance and tensile strength as the known tube stem, The stem bore diameter is preferably about 15% to about 40% of the target diameter and more preferably about 25% of the target diameter. The stem wall has preferably a thickness of about 25 mils to about 50 mils.

In summary, the calculations have shown that for a C103 large bore thin-walled stem: 1) A stem tensile strength equivalent to the known tube stem is obtained with a 35 mil wall. 2) The bending/torsional strength and stiffness is more than twice that of the known tube stem for a wall thickness greater than 17 mils. 3) Buckling of the stem in torsion could be a concern for walls less than 13 mils.

Presently, a comparison of TZM and C103 as material for a large bore, thin-walled, tube stem indicates that TZM provides about 2.7 times the strength and stiffness of C103 at 1100° C. C103 provides about 2.4 times the thermal resistance of TZM at 1100° C. The large bore, thin-walled, tube stem design provides sufficient strength/stiffness in bending and torsion for either stem material selected. The thinness of the stem wall is limited by manufacturing practicality and the susceptibility of the stem to buckling. For a design that is as strong, stiff and thermal resistive as the known tube stem, a TZM stem would be about 13 mils thick; a C103 stem would be about 30 mils thick. The ductility of the C103 provides additional advantages. Standard welding techniques can be used in target and rotor attachment. If mechanical fasteners are selected, cracking under the bolt heads can occur with TZM; C103 will have no problem with cracking. It is easier and less expensive to manufacture C103 tubes than TZM tubes.

Concerning the attachment of the target/stem assembly to the rotor body assembly, a flat bottom plate 120 can be attached to the end of the stem 108 which then attaches to the rotor body assembly 124. For ductile materials, this plate 120 could be welded into place prior to the attachment of the stem 108 into the target/insert combination. This plate 120 serves as support for mechanical fasteners 122.

As illustrated in FIG. 4, in one embodiment of an anode assembly made in accordance with the methods of the present invention, a bottom plate 120, preferably made of C-103 is preferably EB welded to the tubular stem 108. A plurality of holes, preferably four (4), are drilled in the bottom plate 120 for connecting the target/stem assembly to the rotor body assembly 124.

The rotor body assembly 124 comprises at one end a bearing hub 126, possibly made of IN718, and a rotor hub 128 positioned between the bearing hub and the bottom plate 120. In a preferred embodiment, made in accordance with the methods of the present invention, one or more thermal barrier washers 130, made of, for example, a ceramic having a low thermal conductivity such as partially-stabilized zirconia or a metal such as a refractory metal like C103 or a superalloy such as IN718, is inserted for limiting the amount of heat which is transferred from the target/stem assembly 100 to the rotor body assembly 124. The thermal barrier washers 130 provide increased thermal resistance by introducing a highly thermal resistive material into the anode assembly 90 such as, for example zirconia, and by providing additional thermal contact resistance at the contact surface between the mating parts, such as, for example, between the bottom plate 120 and the thermal washer(s) 130.

To operatively connect the rotor body assembly 124 with the target/stem assembly 100, a plurality of fasteners 122, for example, threaded fasteners, preferably made of IN718, TZM or an niobium alloy are passed through the bottom plate 120 through the thermal barrier washer 130 and the rotor hub 128 into threaded portions in the bearing hub 300. These preferably threaded fasteners are then torqued to preferably about 20 in. lbs. to about 60 in. lbs.

As also illustrated in FIG. 4, the connection along seams 110 and 112 provides for a unitary construction of target/tubular stem assembly 100 and a more stable connection to the rotor body assembly 124, which is more resistant to structural changes during the stressing caused by the above mentioned severe protocol uses. Since it has been determined that the anode assembly 90 imbalance problems were, most likely, caused by changes that occur in the area of the target/stem assembly—rotor body assembly connection, the illustrated construction is believed to at least reduce the relative changes in position between the stem, target and rotor thereby significantly reducing tube failures due to anode assembly imbalance.

Because of the large contact surface between the bottom plate 120 and the rotor body assembly 124, multiple fasteners 122, preferably threaded, could be used. With multiple fasteners and the large contact surface (providing stability under bending and unbalance loading), the strength requirements for the fasteners will be less than in prior art small-diameter stem designs.

Figure 8:
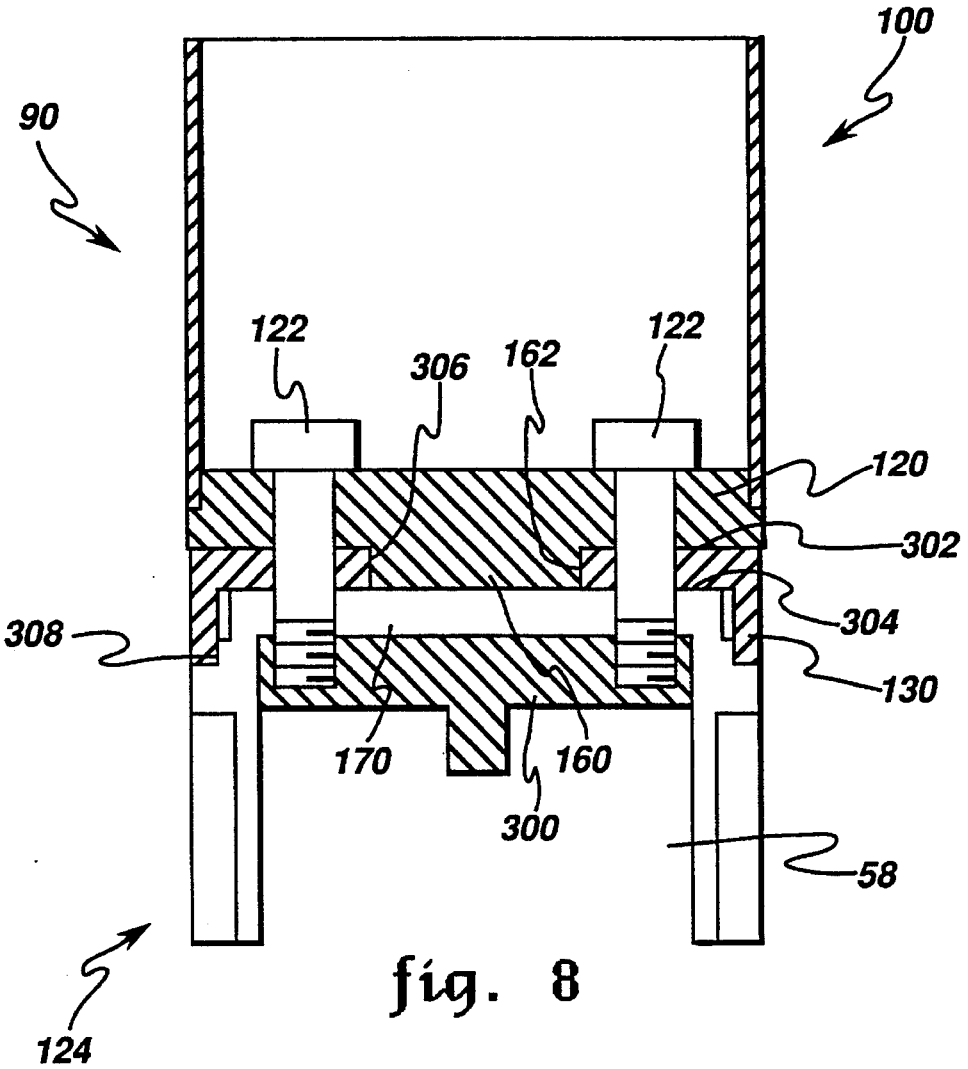
FIG. 8 is a partial sectional view of a target/stem assembly-rotor body assembly connection made according to methods of the present invention.

The use of mechanical fasteners will most likely require the joining of dissimilar metals. Washers between the target/stem assembly and the rotor hub can be used to more closely match the thermal expansion of the fastener material. FIG. 8 illustrates a cross section of a representative anode assembly 90 near the region of the target/stem assembly to rotor body connection of the present invention. It should be understood that there could be more than one set of fasteners 122 and not just the one set of fasteners as illustrated. Specifically, one set of fastener 122 could be bolted to a first and second washer and a second set of fasteners could be bolted to the bearing hub via the second washer. The second set of fasteners would be positioned in the bore of the first washer and offset with respect to the first set of fasteners, for example at about forty five (45) degrees with respect to the location of the first set of fasteners.

In order to maintain long term anode assembly balance, it is important that the alignment between the target/stem assembly 100 and the rotor body assembly 124 be accurate. One approach for achieving such an improved alignment is that the contacting surfaces 302, 304 perpendicular to the axis of the anode assembly are all machined, flat and parallel. Therefore, when the target/stem assembly 100 and the rotor body assembly 124 are assembled together, the top of the target 102 is parallel to all of the contacting surfaces (within specified tolerances, for example 0.001"). Additionally, the contacting surface parallel to the anode assembly axis (shown as surfaces 306 and 308 in FIG. 8) are machined to very tight tolerances, for example 0.0005". These surfaces assure the alignment and concentricity of the combination target/stem assembly and the rotor body assembly with respect to the target.

Any gaps between the parallel contacting surfaces (similar to surfaces 306 and 308 in FIG. 8) must be greater than zero to allow for the thermal washer 130 and the bottom plate cap 120 components to be assembled to the rotor at room temperature. In the past, these particular components, on which the parallel contacting surfaces were machined, were made from dissimilar metal alloys. The alloys used to make these components were selected such that the gap between the connected components increased at operating temperatures. Because significant gaps were present in operating temperatures, either welding or brazing was required to keep these components in contact when the x-ray tube was operating. When a braze was used, these expanding gaps created large strains within the brazed material.

During x-ray tube manufacturing, attachment of the target/stem assembly to the rotor body assembly including the bearing assembly is required as a critical step in the fabrication of the x-ray tube anode assembly 90. The target/stem assembly 100 is a pre-assembled unit containing the target, the stem (shaft or stud) and other hardware. The rotor body assembly 124 is a pre-assembled unit containing the rotor, the thermal barrier (or rotor hub) and other hardware, while the bearing assembly contains the bearing, bearing hub and other hardware.

A typical prior art x-ray anode comprised a the rotor assembly including the rotor and a thermal barrier which were brazed together. The target assembly comprised the target, a shaft or stud (stem) and a rotor hub. The target and stem were inertia welded together and the rotor hub was subsequently bolted to the shaft using a nut; the bolted joint was brazed to secure the nut. The target and rotor assemblies are attached to each other by EB-welding. The rotor was subsequently attached to the bearing assembly by mechanical fasteners (see FIG. 3).

In this prior art design, a hub was required to attach the target to the rotor assembly. The attachment of the stem or shaft to the hub was accomplished by bolting with a nut, followed by brazing to secure the nut. In practice, this approach has two major shortcomings. First, the braze temperature (about 1200° C.) was not much higher than the maximum operating temperature of approximately 975° C. Thus, the braze was not very strong at operating temperatures. Loss of target balance occurred by a number of mechanisms, including creep deformation and failure of the braze material. The second shortcoming was that the materials used in the prior art hub and stem or shaft had different coefficients of thermal expansion. The prior art hub expanded about 2.5 times as much as the shaft (TZM in prior art anodes). Since the target-rotor assembly connection was assembled at room temperature, a clearance existed between the pieces. At operating conditions, this gap increased significantly. The opening of the gap caused the braze to deform a significant amount as the braze attempted to connect the hub to the stem.

In one preferred embodiment made in accordance with the methods of the present invention, the bottom plate 120 and thermal washer 130 (see FIG. 9) are made of a niobium alloy, such as C103. Thus, the bottom plate 120 and the thermal washer 130 have the same coefficient of thermal expansion. Since the bottom plate is closer to the x-ray tube target 102 and thus will see higher temperatures than the thermal washer 130 during tube operating conditions, the knob portion 160 of the bottom plate 120 will expand more than the aperture 161 formed in the thermal washer 130 into which the knob portion 160 fits. Thus, any gaps between the bottom plate and the thermal washer will actually close under operating conditions and compressive stresses will most likely be present at the bottom plate/thermal washer interface 162 during x-ray tube operations. If the initial distances between the adjacent surfaces of the bottom plate 120 and the thermal washer 130 can be designed such that no significant yielding, due to the compressive stresses, takes place, then a tight fit therebetween will be assured during the life of the x-ray tube.

In order to accomplish a target/stem assembly-rotor body assembly connection that maintains balance during the operational life of the x-ray tube, prior to the insertion of the stem into the x-ray target, the bottom plate 120 is rough machined and attached to the stem by a press fit and then welded to the stem. This stem/bottom plate assembly is then attached to the target by a process, similar to those outlined above (see FIG. 5*c*, for example). After attachment of the stem/bottom plate assembly to the target to form the target/stem assembly, the bottom plate 120 is final machined to assure the balance of the target/stem assembly and the alignment of the bottom plate with respect to the target.

Figure 9:
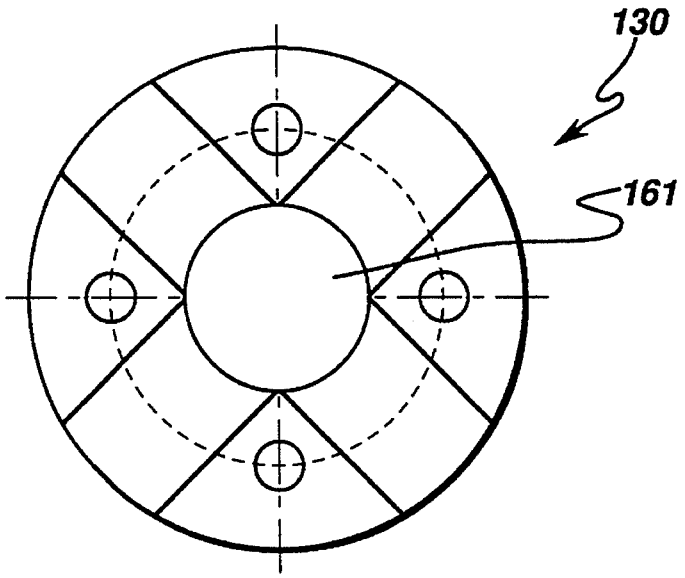
FIG. 9 is a plan view of a thermal washer usable with the target/stem assembly-rotor body assembly connection made in accordance with the methods of the present invention.

Optionally in parallel to this process, the thermal washer 130 is machined to final tolerances. In order to reduce the thermal conduction between the target/stem assembly and the rotor body assembly, an undercut (as shown in FIG. 9) can be machined into the surface of the bottom plate, the thermal washer (if used) or the rotor. The target/stem assembly, thermal washer (if used) and rotor body assembly are aligned as shown in FIG. 8 and are secured by the threaded fasteners 122. These fasteners rest on the surface of the bottom plate, pass through the bottom plate, the thermal washer (if used) and rotor hub, preferably without contact, and then bolt into the bearing hub 300.

In one x-ray system resulting from the methods of the present invention, the thermal washer 130 is made from a niobium alloy, preferably C103. The top portion of the rotor 170 is made from IN718. IN718 has a significantly higher coefficient of thermal expansion than niobium alloys. Therefore, under normal x-ray tube operating conditions, the rotor bearing 172 will expand more in the radial direction than the thermal washer. The gaps between the thermal washer and the rotor bearing will close resulting in compressive stresses at their interface during operation. As with the interface between the bottom plate and thermal washer, if this expansion can be controlled so that no significant yielding, due to the compressive stresses, takes place, a tight fit will be assured during the entire life of the anode assembly of the x-ray tube.

As examples for the above thermal expansion coefficients, the mean thermal coefficient of expansion for niobium alloys is about $7\times10^{-6}$ to about $9\times10^{-6}$ per degree C. and the mean thermal coefficient of expansion for IN718 is about $13\times10^{-6}$ to about $15\times10^{-6}$ per degree C.

After the above process, the connection along seams 110, 112 and between bottom plate 120 and the rotor body assembly 124 provides for a target/stem assembly 100 and rotor body assembly 124 connection which is more resistant to structural changes during the thermal excursion caused by the above mentioned severe protocol uses. Since it has been determined that the imbalance problems were, most likely, caused by changes that occur in the area of the target/stem assembly-rotor body assembly connection, the illustrated methods of making the target/stem assembly and the target/stem assembly-rotor body assembly connection are believed to reduce the relative changes in position between the rotor body assembly and the target/stem assembly and thereby significantly reduce tube imbalance problems.

The following characteristics of the washer(s) is important to proper anode assembly balance: the washer(s) should be machined to high tolerances so that anode assembly balance is not significantly impaired by the introduction of one or more washers to the connection; the washer(s) should be designed (select materials having appropriate thermal expansion coefficients) so that the gaps between adjacent components close up rather than spread apart during operation; the washer(s) should be designed so that compressive stresses between adjacent components do not lead to significant yielding of the washer or the adjacent components during operation; and the washer(s) should be designed so that stresses within the washer do not lead to stresses above the strength of the washer(s) material, especially important when the washer(s) is made of a ceramic.

As will be understood by those skilled in the art, it is also important to ensure that the fastener material and geometry are selected such that a sufficient preload can be initially applied to the target/stem assembly and the rotor body assembly connection and maintained during tube operation. If the preload stresses are too high for the materials and geometry chosen, creep or plastic deformation of the fastener at elevated temperatures might sufficiently decrease the preload such that the fasteners could not function properly and the two assemblies could separate.

The use of mechanical fasteners 122 in conjunction with the products of the methods of the present invention allows for easy disassembly of the target/stem assembly and the rotor body assembly. In the known tube stem assembly, the final target-rotor attachment is made by EB-welding. If significant unbalance results, rework is not possible. For a mechanically fastened design, rework or rebalance is possible.

The following appears to be the advantages of a large-bore, thin-walled target/stem assembly and the target/stem assembly—rotor body assembly made in accordance with the methods of the present invention: allows the target-stem assembly 100 to be attached to the rotor body assembly 124 to form the anode assembly by mechanical fasteners; provides for a large surface contact between the rotor body assembly and the target/stem assembly and, thus, adds to the stability and strength of the target/stem assembly-rotor body assembly connection; fasteners are easily accessed through the top of the target via the hollow tubular stem; if necessary, the rotating anode assembly, which includes the rotor body assembly; and the target/stem assembly, can be disassembled for rework or rebalance during manufacture.

Thermal tests have demonstrated that the fastened target/stem assembly-rotor assembly made by the methods of the present invention provides at least as much thermal resistance as known tube designs where the stem is attached to the target by either bolting or inertia welding.

While the methods disclosed herein constitute preferred embodiments of the invention, it is to be understood that the invention is not limited to these precise methods, and that changes may be made therein without departing from the scope of the invention which is defined in the appended claims.

What is claimed is:

1. A method for connecting a target/stem assembly to a rotor body assembly for use in a rotating x-ray tube, comprising the steps of:

providing a target;

providing a large bore, thin-walled tubular stem;

providing a bottom plate;

connecting the bottom plate to the tubular stem;

connecting the tubular stem/bottom plate combination to the target;

machining the bottom plate to obtain proper target/stem assembly balance and proper alignment between the bottom plate and the target/stem assembly;

providing at least one thermal washer;

machining the thermal washer to exact tolerances;

positioning the target/stem assembly proximate a rotor body assembly;

positioning the thermal washer between the target/stem assembly and the rotor body assembly; and connecting the target/stem assembly to the rotor body assembly with a plurality of fasteners to form an anode assembly.

2. A method for connecting a target/stem assembly to a rotor body assembly for use in a rotating x-ray tube, comprising the steps of:

providing a target;

providing a large bore, thin-walled tubular stem;

providing a bottom plate;

connecting the bottom plate to the tubular stem;

connecting the tubular stem/bottom plate combination to the target;

machining the bottom plate to obtain proper target/stem assembly balance and proper alignment between the bottom plate and the target/stem assembly;

positioning the target/stem assembly proximate a rotor body assembly; and connecting the target/stem assembly to the rotor body assembly to form an anode assembly.

3. The method of claim 2, wherein the bottom plate is welded to the tubular stem.

4. The method of claim 2, wherein the bottom plate has at least one undercut machined therein for reducing thermal conduction between the target/stem assembly and the rotor body assembly.

5. The method of claim 2, wherein the rotor has at least one undercut machined therein for reducing thermal conduction between the target/stem assembly and the rotor body assembly.

6. The method of claim 2, wherein the material for the thermal washer is a ceramic.

7. The method of claim 2, wherein the material for the bottom plate is a niobium alloy.

8. The method of claim 2, wherein the material for the bottom plate is comprised of a material selected from the group consisting of:

CB-752 (Nb,10W,2.5Zr); C129Y (Nb,10W,10Hf,0.1Y); FS-85 (Nb,28Ta,11W,0.8Zr); and C103 (Nb,10,Hf,1Ti, 0.7Zr).

9. The method of claim 2, wherein the material for the tubular stem comprises a niobium alloy.

10. The method of claim 2, wherein the tubular stem comprises a material chosen from the group consisting of:

CB-752 (Nb,10W,2.5Zr); C129Y (Nb,10W,10Hf,0.1Y); FS-85 (Nb,28Ta,11W,0.8Zr); and C103 (Nb,10,Hf,1Ti, 0.7Zr).

11. The method of claim 2 further comprising the step of:

connecting the target/stem assembly to the rotor body assembly with a plurality of fasteners to form an anode assembly.

12. The method of claim 10, wherein the fasteners comprise a niobium alloy.

13. The method of claim 2 further comprising the step of:

providing at least one thermal washer.

14. The method of claim 13, wherein the thermal washer has at least one undercut machined therein for reducing thermal conduction between the target/stem assembly and the rotor body assembly.

15. The method of claim 13, wherein the material for the thermal washer is a niobium alloy.

16. The method of claim 13, wherein the material for the thermal washer is a ceramic.

17. The method of claim 13, wherein the material for the thermal washer is partially-stabilized zirconia.

18. The method of claim 2 further comprising the step of:

machining the thermal washer to exact tolerances.

19. The method of claim 3 further comprising the step of:

positioning the thermal washer between the target/stem assembly and the rotor body assembly.

* * * * *